US005662179A

United States Patent [19]

Falk

[11] Patent Number: 5,662,179

[45] Date of Patent: Sep. 2, 1997

[54] HOLE-MAKING DEVICE

[75] Inventor: Johan Falk, Hudiksvall, Sweden

[73] Assignee: Hudiksvalls Teknik Centrum AB, Hudiksvall, Sweden

[21] Appl. No.: 525,615

[22] PCT Filed: May 31, 1994

[86] PCT No.: PCT/SE94/00516

§ 371 Date: Sep. 29, 1995

§ 102(e) Date: Sep. 29, 1995

[87] PCT Pub. No.: WO94/27687

PCT Pub. Date: Dec. 8, 1994

[30] Foreign Application Priority Data

Jun. 1, 1993 [SE] Sweden ..... 9301854

[51] Int. Cl.[6] ..... E21B 1/02

[52] U.S. Cl. ..... 175/20; 172/22; 173/126; 175/135

[58] Field of Search ..... 175/20, 135, 321; 173/90, 126, 18; 172/22

[56] References Cited

U.S. PATENT DOCUMENTS

| | | | |
|---|---|---|---|
| 1,692,436 | 11/1928 | Deane | 172/22 X |
| 2,574,605 | 11/1951 | Van Pelt | 173/126 X |
| 3,015,365 | 1/1962 | Griffin et al. | 175/135 |
| 3,050,095 | 8/1962 | Prather | 173/126 X |
| 3,696,873 | 10/1972 | Anderson | 175/20 |
| 4,589,500 | 5/1986 | Moraly | 173/90 |
| 4,884,638 | 12/1989 | Hoffman | 172/22 |
| 5,492,181 | 2/1996 | Grant | 172/22 |
| 5,517,868 | 5/1996 | Turriff et al. | 175/20 X |

FOREIGN PATENT DOCUMENTS 2031484 4/1980 United Kingdom .

*Primary Examiner*—Hoang C. Dang
*Attorney, Agent, or Firm*—Jacobson, Price, Holman & Stern, PLLC

[57] ABSTRACT

A device for making holes in the ground, such as for a golf course, has a tubular cutter having an open first end for insertion into the ground, and an opposite second end from which a guide extends. A percussion weight is guided for movement along the guide and exerts a hammering force on the second end of the cutter. A tubular part is connected to the end of the percussion weight that lies distal from the tubular cutter. The tubular part guides the percussion weight axially along the guide. A handle for maneuvering of the percussion weight is attached to the top of the tubular part. The cutter and associated guide on the one hand, and the percussion weight with associated tubular part carrying the handle on the other hand, can be locked together releasably against axial movement, are non-rotatable, and are also releasably locked against rotation movement, so that the cutter can be easily removed from the ground once the hole is cut.

13 Claims, 2 Drawing Sheets

HOLE-MAKING DEVICE

BACKGROUND OF THE INVENTION

1. Field of the Invention

The present invention relates to a device for making holes in the ground, and then particularly for making holes in golf putting greens, wherein the device includes a tubular cutter having an open first end for insertion into the ground, and an opposite second end from which there extends a guide means along which there is movably guided a percussion weight which is intended to exert a hammering force on the upper end of the cutter when the device is in its use position.

2. Description of the Related Art

A device of the aforedescribed kind for making holes in putting greens is known from GB 2 031 484 for instance. The percussion weight, or hammer, has the form of a handgrip and is intended to be lifted by one hand of the user and then thrown down against the upper end of the cutter, so as to hammer the cutter into the ground. In the case of this known device, it is necessary for the user to hold the device in a position in which the desired hole can be obtained, normally a vertical hole, with his/her free hand. After having hammered the cutter down to the depth desired, in the case of golf to a depth of about 200 cm, and therewith filling the interior of the cutter with a corresponding core or plug of grass and soil, the device is twisted so as to loosen the plug from the surrounding earth. The hole making device and the plug are then lifted from the ground, whereafter the plug can be ejected with the aid of an ejector mechanism into an earlier used green hole and therewith refill the hole, while inserting a tubular liner into the newly made hole and therewith complete the hole making operation.

SUMMARY OF THE INVENTION

The object of the present invention is to provide a novel and advantageous device for making holes in the ground, and then particularly in putting greens, which includes a percussion weight and with which it is possible to maneuver the percussion weight with both hands while being able to hold the device in a desired position relative to the ground.

In accordance with the invention there is proposed to this end a device of the kind defined in the introduction wherein a tubular part provided with a handgrip for maneuvering the percussion weight is connected to the end of the percussion weight that lies distal from the tubular cutter, said tubular part being mounted for axial movement along the guide means, wherein on one hand the cutter and associated guide means and on the other hand the percussion weight or hammer with associated tubular part that includes the handgrip can be locked releasably against axial relative movement and are non-rotational in relation to one another, or are releasably locked together also against rotational movement.

The percussion weight of this device can be maneuvered comfortably in an ergonomically satisfactory manner via the handgrip located on the movably mounted tubular part. This latter part can be locked in relation to its guide means, so as to enable the cutter to be twisted loose from the ground while filled with grass and soil plug, and to enable the plug to be lifted from the ground together with the cutter.

BRIEF DESCRIPTION OF THE DRAWINGS

The invention will now be described in more detail with reference two exemplifying embodiments of the invention and with reference to the accompanying drawings, in which.

Figure 1:
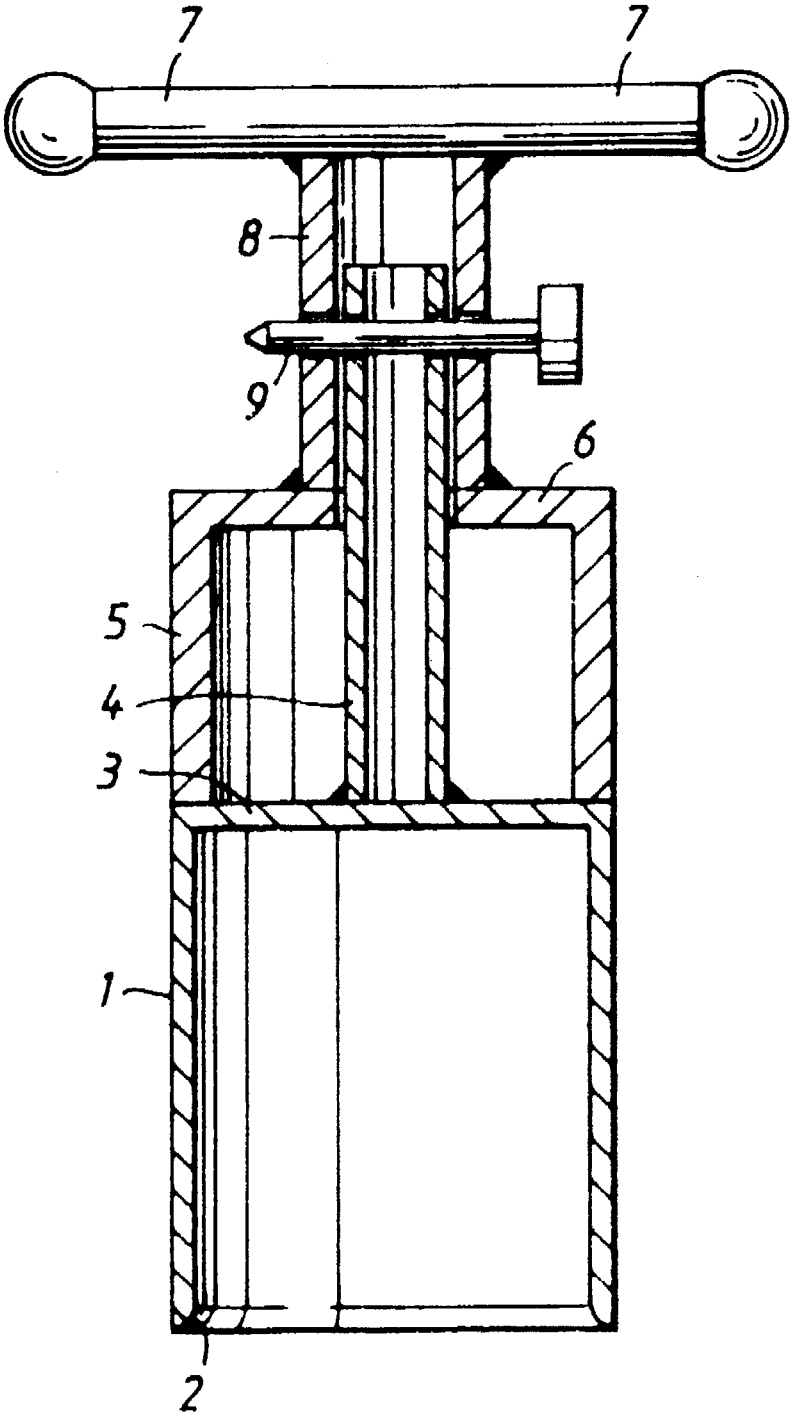
FIG. 1 is a schematic vertical axial section view of a first exemplifying embodiment of an inventive device.

Corresponding or essentially corresponding components illustrated in the different figures of the drawing have been identified with the same reference signs.

DETAILED DESCRIPTION OF THE PREFERRED EMBODIMENT

The device for making holes in the ground, particularly in golf greens, illustrated in FIG. 1 comprises a cylindrical cutter 1 which includes a bottom cutting edge 2 and an upper end wall 3. Connected centrally to the end wall 3 is a guide means 4, in the illustrated case a tubular guide means, which extends up from the upper surface of the end wall 3. A percussion weight or hammer means 5 in the form of a cylindrical thick-wall tubular member has an outer diameter which corresponds to the outer diameter of the cutter 1. When the device is intended for forming holes in putting greens, the cutter 1 will preferably have an outer diameter of about 108 mm. The cylindrical percussion weight 5 includes at the top thereof an end wall 6 in which there is provided a central opening through which the guide means 4 extends. Connecting with the opening in the end wall 6 is a second guide means or tubular part 8 which is provided at the top thereof with a handgrip 7 and which is movably mounted on the guide means 4. The guide means 4 and the tubular part 8 include mutually registered, diametrical holes through which a cotter pin 9 can be inserted so as to releasably lock the guide means 4 and the tubular part 8 against movement in an axial direction and against rotational or twisting movement about their longitudinal axes.

When using the device shown in FIG. 1 to make a hole in the ground, the cotter pin 9 is first removed and the percussion weight 5 is repeatedly lifted with the aid of the handgrip 7 and thrown down against the cutter 1, while guided by the guide means 4 via the tubular part 8. The percussion force is therewith applied to the upper edge of the cutter 1 with the minimum of undesirable resilience. The tool is readily held in its intended position of alignment with the ground by means of the handgrip with the use of both hands in a desirable manner while driving the cutter into the ground.

When the cutter 1 has been driven into the ground to the depth desired, the second guide means or tubular part 8 can then be locked to the guide means 4 with the aid of the cotter pin 9. The device is then twisted about a generally vertical axis and pulled out of the ground with the aid of the handgrip, so as to loosen an earth plug that has penetrated into the cutter 1 and to lift the plug from the ground while leaving a cylindrical hole therein.

Figure 2:
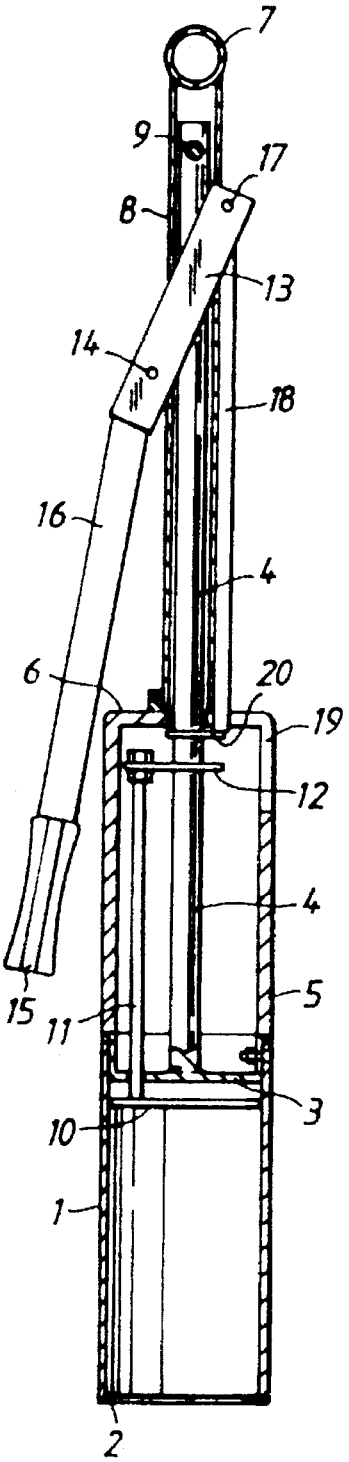
FIG. 2 is a vertical axial section view of a second exemplifying embodiment of the inventive device.
Figure 3:
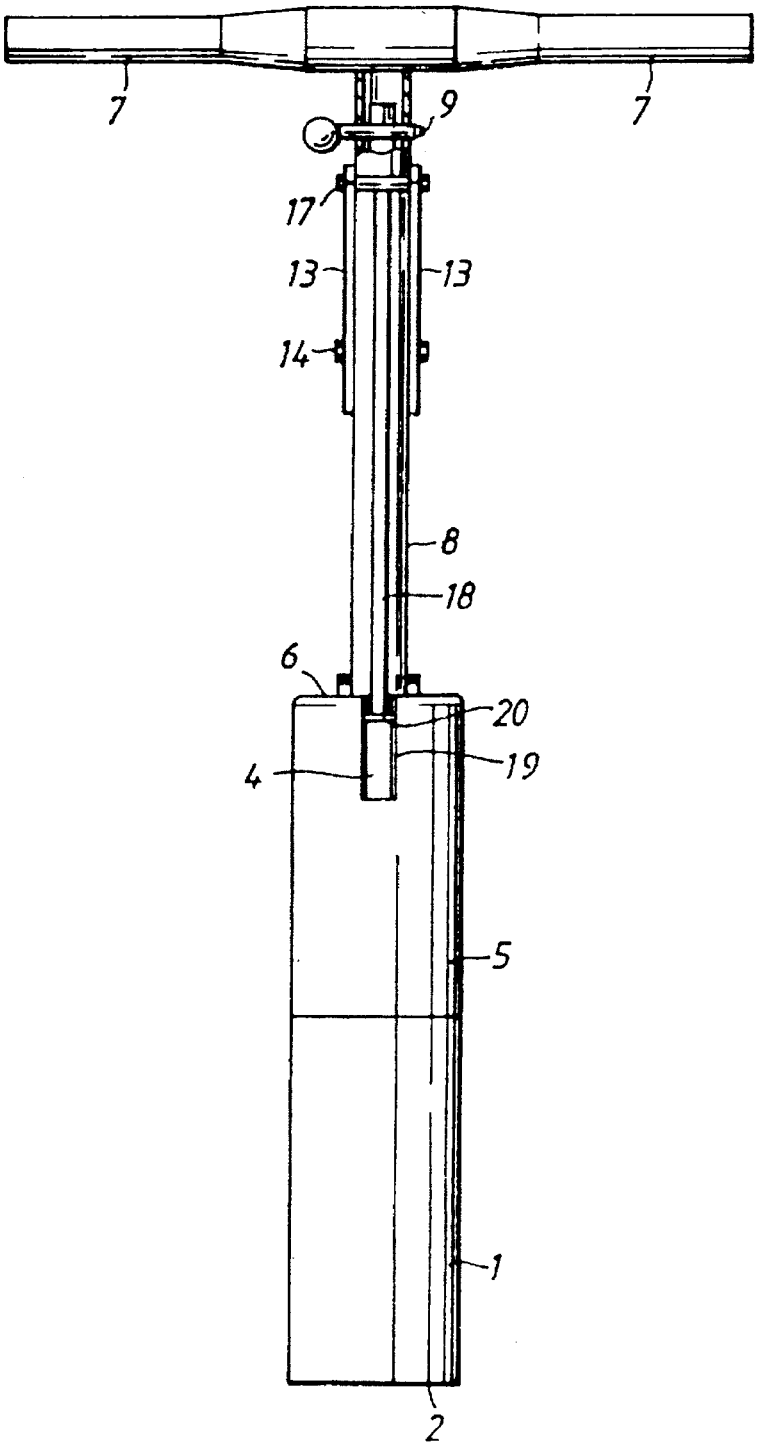
FIG. 3 is essentially a side view of the device shown in FIG. 2, taken from the right in FIG. 2.

It will be understood that the tubular part 8 may be guided by the guide means 4 both for axial and rotational movement, or for axial movement but with the tubular member held against rotational movement, in which latter case the cotter pin 9 need only be used in conjunction with pulling the cutter 1 from the hole formed in the ground. It will also be understood that the device is shown very schematically in FIG. 1. FIGS. 2 and 3 illustrate a conceivable construction of an inventive device in practice.

As with earlier described device, the inventive device illustrated in FIGS. 2 and 3 also includes a cutter 1 having an end wall 3 and guide means 4, a percussion weight or hammer means 5, a tubular part 8, a handgrip 7 and a cotter pin 9 by means of which the guide means 4 and the tubular part 8 are releasably locked together, said cotter pin being seen more clearly in the sectional view of FIG. 3. The device illustrated in FIGS. 2 and 3 has a vertical length which enables the user to make a hole in the ground in the manner described with reference to FIG. 1 while standing with an essentially straight back. FIG. 2 and 3 illustrate a mechanism for ejecting an earth plug that has entered the cutter when driving the cutter into the ground. The ejector mechanism is comprised in a known manner of an ejector plate 10 having arranged thereon upstanding pins 11 which are guided in holes provided in the end wall 3. The upper ends of the pins 11 are attached to a plate 12 having a central opening (not shown) through which the guide means 4 extends and is movable in an axial direction. Only one pin 11 is visible in the sectional view of FIG. 2. In practice, three pins are preferably disposed generally uniformly around the guide means 4.

The plate 10 tends to adopt a lower position under the influence of gravity, and the plate 12 will therefore rest on the upper side of the end wall 3, with the plate 10 located immediately above the cutting edge 2 of the cutter 1. The plate 10 is pressed upwards to the position shown in FIG. 2 by the grass and soil plug that penetrates into the cutter 1 while making a hole in the ground.

The ejector plate 10 is activated by means of a system of rods and links which comprises a two-arm lever which is formed by two parallel plates 13 and which is pivotally mounted on a pivot pin 14 provided on the tubular part 8. Attached to one end of the lever 13 is a rod 16 which is provided with a handgrip or handle 15, while a pressure rod 18 is pivotally connected to the other end of the lever on that side of the tubular part 8 opposite to the rod 16, by pivot pin 17. The bottom end of the pressure rod 18 extends through a slot 19 into the interior of the percussion weight 5 and carries a ring 20 which is mounted for axial movement on the guide means 4. An earth plug is ejected from the cutter 1 by swinging the rod 16 clockwise in FIG. 2 about the pivot pin 14 to an upstanding position, wherewith the pressure rod 18 moves downwards so as to press the plate 12, via the ring 20, and therewith also the ejector plate 10, via the pins 11, in a downward direction to eject the earth plug from within the cutter 1. It will be understood that the invention is not restricted to the exemplifying embodiments thereof illustrated in the accompanying drawings, and that the device can be realized in any desired manner within the scope of the inventive concept defined in the following claims.

I claim:

1. A device for making holes in the ground which comprises a tubular cutter having an open, first end for insertion into the ground, and an opposite, second end from which there extends a guide means along which a percussion weight is guided for movement, said percussion weight being intended to exert a hammering force on said second end, a tubular part connected to the percussion weight at an end thereof which lies distal from the tubular cutter such that the tubular part and percussion weight are guided for axial movement along the guide means, said tubular part being provided with a handgrip for maneuvering the percussion weight, the handgrip being mounted on the end of the tubular part that lies distal from the percussion weight; and a locking mechanism for releasably locking the cutter and associated guide means and the percussion weight and associated tubular part provided with said handgrip together against movement in an axial direction and against rotational movement.

2. A device according to claim 1, wherein the percussion weight is tubular and has an outer diameter which is substantially the same as the outer diameter of the tubular cutter.

3. A device according to claim 1, and further comprising an ejector mechanism for ejecting an earth plug that has been pressed into the cut interior.

4. The device of claim 1, wherein the locking mechanism comprises a cotter pin removably insertable in through-holes located in respective portions of the guide means and tubular part.

5. A device for making holes in the ground, comprising a tubular cutter having an outer diameter defining a central opening, an open first end for insertion into the ground, and an opposite, second end from which there extends a guide means along which a percussion weight is guided for movement, said percussion weight exerting a hammering force on said second end, the percussion weight being tubular and having an outer diameter that is substantially the same as the outer diameter of the tubular cutter; said device further comprising a tubular part connected to the percussion weight at an end thereof which lies distal from the tubular cutter such that the tubular part is guided for axial movement along the guide means, said tubular part being provided with a handgrip for maneuvering the percussion weight; and a locking mechanism for releasably locking the cutter and associated guide means and the percussion weight and associated tubular part provided with said handgrip together against movement in an axial direction and against rotational movement.

6. A device according claim 5, the handgrip being mounted on the end of the tubular part that lies distal from the percussion weight.

7. A device according to claim 5, further comprising an ejector mechanism for ejecting an earth plug that has been pressed into the cutter interior.

8. The device of claim 5, wherein the locking mechanism comprises a cotter pin removably insertable in through-holes located in respective portions of the guide means and tubular part.

9. A device for making holes in the ground comprising:

a generally vertical cutter having an open lower end to be inserted into the ground and a closed upper end forming an axial cavity and defining an outer periphery;

an elongated guide connected to the upper end of said cutter;

a percussion weight positioned above said cutter and having a side wall, an open lower end, and an upper end with a central opening therein forming an axial cavity and defining an outer periphery, the outer periphery of said percussion weight being substantially equal to the outer periphery of said cutter;

a vertically extending shaft having a lower end connected about the opening of said percussion weight and an axial cavity for slidably receiving said elongated guide and guiding said percussion weight along said guide, said shaft further including an upper end located opposite the lower end of said shaft; and, a handgrip connected to the upper end of said shaft for sliding said percussion weight along said elongated guide so that the lower end of said percussion weight exerts a hammering force on the outer periphery of the upper end of said cutter.

10. The device of claim 9, and further comprising a cotter pin and through holes located in respective portions of each said guide and said shaft, the through holes releasably receiving said cotter pin to releasably lock said cutter and guide with said percussion weight, shaft and said handgrip to prevent axial and rotational movement.

11. The device according to claim 9, further comprising an ejector mechanism for ejecting an earth plug that has been pressed into the lower end of said cutter.

12. The device of claim 9 wherein the side walls of said cutter and said percussion weight are generally cylindrical.

13. The device of claim 9 wherein the side wall of said percussion weight is substantially thicker than the side wall of said cutter.

* * * * *